US005326295A

United States Patent [19]

Nakayama

[11] Patent Number: 5,326,295

[45] Date of Patent: Jul. 5, 1994

[54] EXHAUST SYSTEM FOR MARINE PROPULSION UNIT

[75] Inventor: Manabu Nakayama, Hamamatsu, Japan

[73] Assignee: Sanshin Kogyo Kabushiki Kaisha, Hamamatsu, Japan

[21] Appl. No.: 105,038

[22] Filed: Aug. 11, 1993

[30] Foreign Application Priority Data

Aug. 17, 1992 [JP] Japan ..... 4-240025

[51] Int. Cl.[5] ..... B63H 23/32

[52] U.S. Cl. ..... 440/89; 60/302

[58] Field of Search ..... 440/88, 89, 900; 181/220, 221, 235; 60/282, 298, 299, 302

[56] References Cited

U.S. PATENT DOCUMENTS 4,421,490 12/1983 Nakahama ..... 440/89
4,799,905 1/1989 Broughton et al. ..... 440/89
4,900,282 2/1990 Takahashi et al. ..... 440/89
4,906,214 3/1990 Towner ..... 440/89
5,203,167 4/1993 Lassanske et al. ..... 440/89

FOREIGN PATENT DOCUMENTS 57-140293 8/1982 Japan .
62-199918 9/1987 Japan .

*Primary Examiner*—Stephen P. Avila
*Attorney, Agent, or Firm*—Knobbe, Martens, Olson & Bear

[57] ABSTRACT

Several embodiments of external low speed exhaust gas discharge treatment devices for outboard motors that may be attached to the outer housing of the outboard motor to provide silencing for the exhaust gases without necessitating complicated driveshaft housing constructions.

15 Claims, 5 Drawing Sheets

EXHAUST SYSTEM FOR MARINE PROPULSION UNIT

BACKGROUND OF THE INVENTION

This invention relates to an exhaust system for a marine propulsion unit and more particularly to an improved exhaust system for an outboard motor and particularly to a low speed exhaust gas discharge for such outboard motors.

The problem of exhaust gas treatment in marine propulsion units and particularly outboard motors are well known. One of the main difficulties in providing an effective exhaust system for an outboard motor is the fact that the space in which the exhaust gases may be treated is substantially limited. It is the conventional practice to provide an expansion chamber and possibly other silencing device in the drive shaft housing to which exhaust gases are delivered from the engine of the powerhead by an exhaust pipe. These exhaust gases are then discharged through a high speed underwater exhaust gas discharge which may be formed in the lower unit or in the hub of the propeller. Although such systems are relatively effective, when the outboard motor and associated watercraft are traveling at a low speed or idling, the underwater discharge becomes very deeply submerged and the exhaust gas pressures are not great enough to permit their passage through this discharge.

It is, therefor, the common practice to provide an additional, above the water low speed exhaust gas discharge. This discharge is conventionally formed in either the upper portion of the drive shaft housing or in a lower portion of the powerhead itself and communicates with either the expansion chamber or some other point in the exhaust system. When the outboard motor is operating at the low speed conditions, as aforenoted, the exhaust gases can exit through this above the water exhaust gas discharge. Of course, it is necessary to insure that this discharge is somewhat restricted so as to insure that any large portions of the exhaust gases will not flow out of this opening when traveling at other than low speeds or at idle.

The exhaust gases which exit the above the water exhaust gas discharge obviously do not have the benefit of the full silencing afforded by the underwater exhaust gas discharge. In addition, the above the water exhaust gas discharge is in closer proximity to the operator and thus there is problem of noise generation with the systems.

The noise from the above the water exhaust gas discharge can be further silenced by providing either a labyrinthian flow in the upper casing and/or by including expansion chamber volumes. However, there are disadvantages with these types of arrangements.

Specifically, if a labyrinthian type of flow is to be provided, then the drive shaft housing casting either becomes complicated or addition parts must be formed and fixed within the drive shaft housing. This is not always feasible due to the desire to maintain a relatively low and uncomplicated drive shaft housing assembly.

Even greater problems exist with attempts to provide expansion chambers since the effectiveness of an expansion chamber depends to a large extent on its volume and the configuration and size of the drive shaft housing does not permit the use of large expansion chambers.

There is also the problem attendant when the outboard motor is operating at the low speed conditions.

Water will back up in the interior of the drive shaft housing and this can further reduce the available size for expansion chambers and the like unless there is some further methodology employed so as to seal the expansion chambers from this water influx, which again complicates the casting process for the drive shaft housing.

It is, therefor, a principal object of this invention to provide an improved exhaust silencing arrangement for a marine propulsion unit.

It a further object of this invention to provide an improved low speed silencing system for an outboard motor that can employ fairly large expansion chambers and/or labyrinthian type flow systems without complicating the drive shaft housing construction or substantially increasing the size of the drive shaft housing.

It is a still further object of this invention to provide an improved arrangement for providing external silencing for the low speed exhaust gas discharge of an outboard.

SUMMARY OF THE INVENTION

This invention is adapted to be embodied in an outboard motor having an outer housing assembly comprised of a drive shaft housing and a protective cowling for an internal combustion engine. An exhaust system for the engine comprises a high speed underwater exhaust to which exhaust gases are delivered from the engine through the driveshaft housing. An above the water exhaust gas discharge port is formed in the outer housing assembly at a point above the water level under all conditions of the outboard motor when attached to an associated watercraft and which communicates with the exhaust system for discharging exhaust gases directly to the atmosphere. An exhaust treatment device is affixed to the outer housing assembly and has an inlet opening communicating with the above the water exhaust gas discharge port and an outlet opening communicating with the atmosphere.

DETAILED DESCRIPTION OF THE PREFERRED EMBODIMENTS OF THE INVENTION

Figure 1:
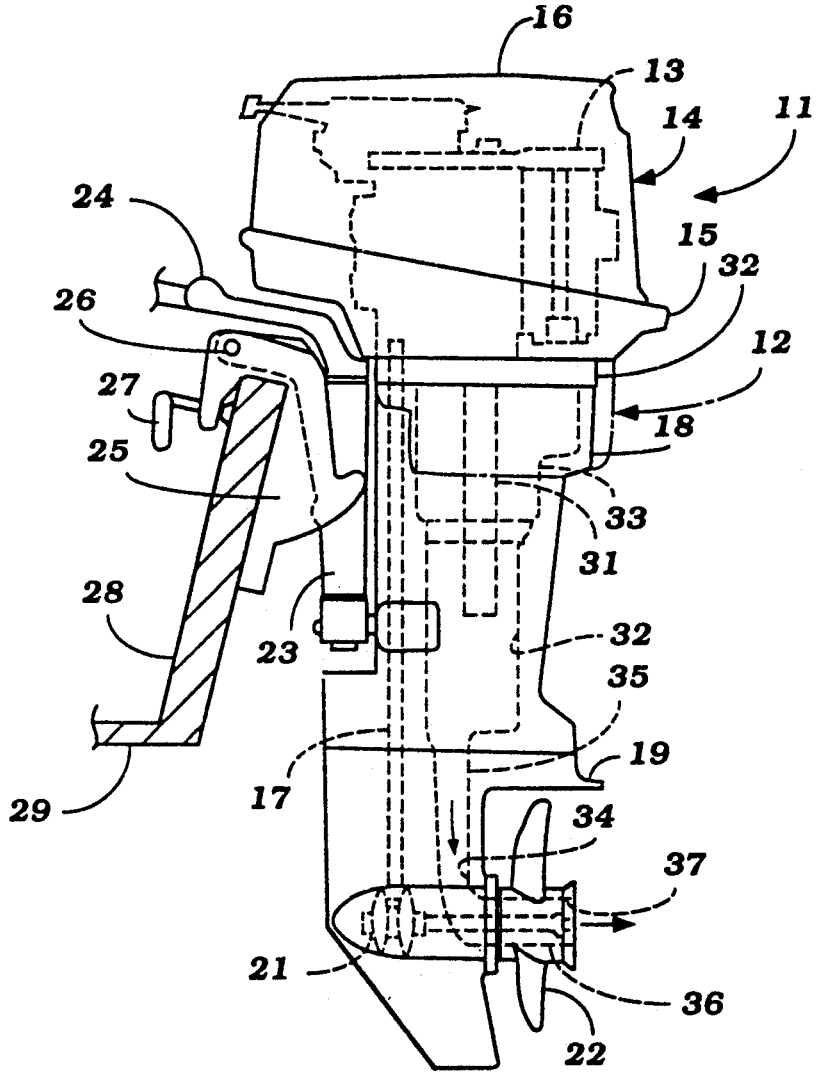
FIG. 1 is a side elevational view of an outboard motor constructed in accordance with an embodiment of the invention, with a first embodiment of silencing device being shown in phantom.

Referring now in detail to the drawing and initially to FIG. 1, an outboard motor constructed in accordance with a first embodiment of the invention is identified generally by the reference numeral 11. In this Figure an exhaust treatment device constructed in accordance with this embodiment is shown partially in phantom lines and is identified generally by the reference numeral 12. Except for this exhaust treatment device 12, the outboard motor 11 may be considered to be conventional and may employ a silencing system of the type generally described and shown in U.S. Pat. No. 4,421,490 entitled EXHAUST SILENCER STRUCTURE FOR OUTBOARD ENGINES, issued Dec. 20, 1983 and assigned in part to one of the assignees of this application. Where any details of the outboard motor and/or its exhaust system are not described, reference may be had to that patent for those omitted details. Alternatively, the outboard motor 11, except for the exhaust treatment device 12 may be of any known type of construction and it may include any known type of internal silencing system for the exhaust gases.

The outboard motor 11 includes a powerhead that is comprised of an internal combustion engine 13 which may be of any know type and which is contain within an outer housing assembly that is comprised of a protective cowling 14. The cowling 14 includes a lower tray member 15 and an upper removable cover portion 16.

As is conventional with outboard motor practice, the engine 13 is supported within the powerhead so that its output shaft rotates about a vertically disposed axis so as to be coupled to drive shaft 17 which depends into and is journalled in a drive shaft housing 18 in a well known manner. This drive shaft 17 depends into a lower unit 19 in which a forward neutral reverse transmission 21 is provided for driving a propeller 22 in selected forward or reverse directions.

A steering shaft (not shown) is affixed in a suitable manner to the drive shaft housing 18 and is supported for steering movement within a swivel bracket 23. This steering shaft has a tiller 24 affixed to its upper end for steering of the outboard motor 11 in a well known manner.

The swivel bracket 23 is, in turn, connected to a clamping bracket 25 for tilt and trim movement about a horizontally disposed tilt axis defined by a pivot pin 26. The clamping bracket 25 carries a clamping device 27 for detachably affixing the outboard 11 to a transom 28 of an associated watercraft shown partially in cross-section in FIG. 1 and identified by the reference numeral 29.

Outboard motor 11 includes an exhaust system for discharging the exhaust gases from the engine 13 and, although this exhaust system appears in more detail in FIGS. 2 and 3, certain portions of it appear only in FIG. 1 and, therefor, the system will be described in general detail initially in FIG. 1 and then in greater detail by reference to FIGS. 2 and 3.

The engine 13 is provided with an exhaust manifold (not shown) that communicated with an exhaust pipe 31 that is affixed in manner to be described to a plate 32 that connects the engine 3 to the drive shaft housing 18. This exhaust pipe 31 depends into an expansion chamber 32 formed in part by an internal shell 3 within the driveshaft housing 18. This expansion chamber, in turn, communicates with an exhaust discharge passageway 34 of a high speed exhaust gas discharge which is formed by a pipe 35 that extends from the lower end of the expansion chamber 32 into the lower unit. This pipe 35 communicates with a high speed exhaust gas discharge 36 that is formed the hub 37 of the propeller 22 for underwater discharge of the exhaust gases when traveling at high speed.

As is well known in this art, when the outboard motor 11 is powering the associated watercraft 29 either under and idle condition in neutral or driving it at low speeds the underwater exhaust gas discharge 36 will be too deeply submerged and the exhaust gas pressure too low for exhaust gas discharge through this path. Therefor, there is provided an above the water low speed exhaust gas discharge which now be described by reference to FIGS. 2 and 3 along with other details of the exhaust system.

Figure 2:
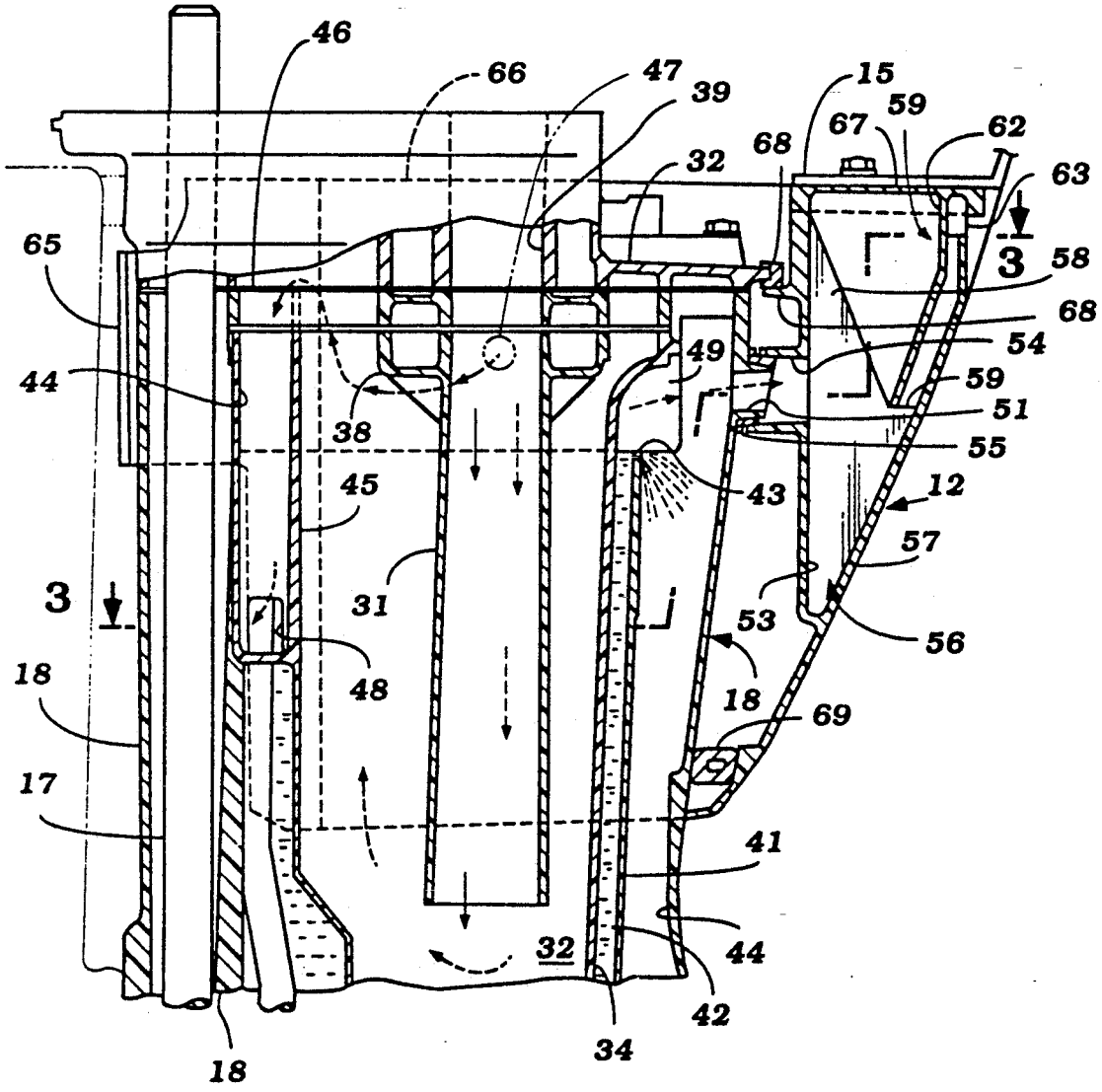
FIG. 2 is an enlarged view of the area of the outboard motor showing the silencing device in accordance with this embodiment in solid lines, with portions broken away so as to more clearly show the construction.
Figure 3:
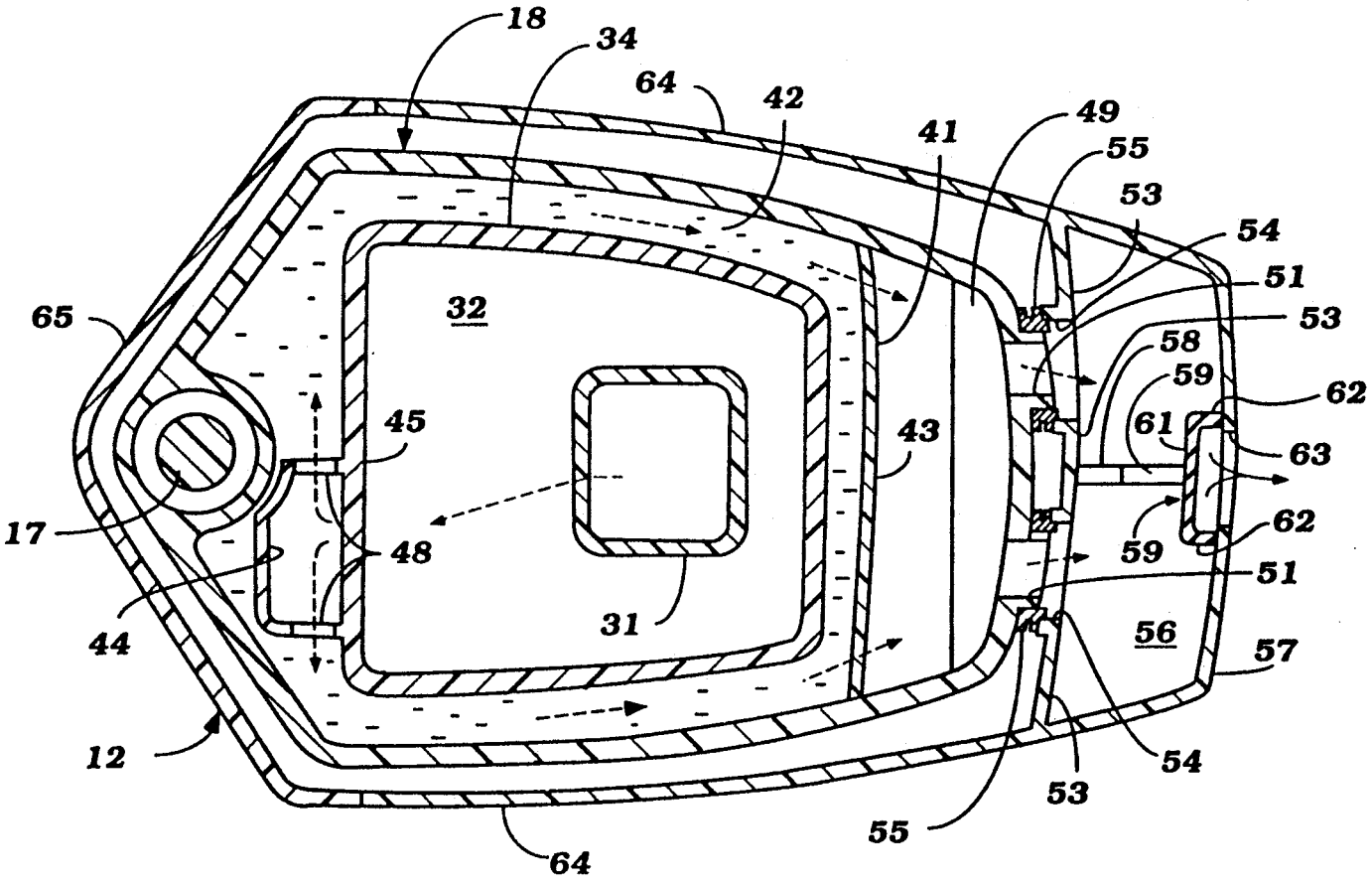
FIG. 3 is a cross-sectional view taken along the line 3—3 of FIG. 2.

As may be seen in FIGS. 2 and 3, the exhaust pipe 31 has an enlarged upper portion 38 that is affixed to the underside of the plate 32 and which portion 38 in communication with an exhaust gas discharge port 39 formed in the plate 32 which, in turn, communicates with an exhaust manifold of the engine as previously described. The lower end of the exhaust pipe 31 extends into the expansion chamber 32 which, as has been noted, is formed by an inner shell 34 contained within the driveshaft housing 18. A further inner-shell portion 41 defines a water chamber 42 around the expansion chamber 32. Water is delivered to this water chamber 42 from the cooling system of the engine for discharge back into the body water in which the watercraft is operating. This water jacket and specifically the shell portion 41 has a weir 43 over which water may flow to a cavity 44 formed around the shell 41 by the inner surface of the driveshaft housing 18 for discharge back into the body of water in which the watercraft is operating.

The low speed exhaust gas discharge passage and silencing system will now be described by continued reference primarily to FIGS. 2 and 3. This system includes a vertically extending exhaust gas passage 44 that is formed forwardly of a forward wall 45 of the expansion chamber forming shell member 34. Exhaust gases can flow to this passage 44 through an upwardly facing inlet opening 46 formed above the water level defined by the weir 43 from either the expansion chamber 32 or from a low speed exhaust discharge passage 47 that communicates the interior of the exhaust pipe 31 with the inlet 46. A pair of discharge passages 48 are formed at the lower ends of the exhaust passage 44 and discharge the exhaust gases into the water jacket 42 below the water level therein. Thus, the idle or low speed exhaust gases must flow through this head of water which is uniform so as to provide some silencing. The flow of exhaust gases in the low speed exhaust gas system is indicated by the arrows in FIGS. 2 and 3

These exhaust gases are then delivered to a collector chamber 49 formed at the rear of the unit above the chamber 44. One or more low speed atmospheric exhaust gas discharge passages 51 are formed in the driveshaft housing 18 at a point above the water level. In the illustrated construction, there are two such exhaust passages 51 as clearly shown in FIG. 3. Normally these exhaust passages will communicate directly with the atmosphere and, accordingly, there is relatively little silencing for the idle or low speed exhaust gas discharge. Of course, the passage through the water jacket 42 will provide some silencing but not enough.

In order to provide further silencing without enlarging the shape of the driveshaft housing 18 or without requiring complicated casting techniques or internal baffles there is provided an external exhaust silencing arrangement, that is provided by the external exhaust silencing device 12 and which, in this embodiment, is formed like a collar that encircles the upper potion of the driveshaft housing 18.

The device may be formed from any suitable material such as a cast aluminum alloy or the like and is formes as a multi-part construction as will be described. This exhaust treatment device 12 is comprised of an internal wall portion 53 that has a pair of inlet openings 54 that are adapted to sealingly communicate with the above the water exhaust gas discharge openings 51 of the driveshaft housing 17 with sealing gaskets 55 interposed therebetween. These inlet openings 54 communicate with an expansion chamber 56 formed between the wall 53 and the remainder of an outer wall 57 of the exhaust treatment device 12. This expansion chamber 56 is divided into a pair of side by side portions by a vertical baffle 58 which forms a stiffening member for rear portion of the exhaust treatment device 12 and which is formed with a cut out or notch 59.

This cut out or notch 59 accommodates an internal baffle plate, indicated generally by the reference numeral 59, which may be formed from any suitable material and which has back wall 61 and side walls 62 so as to form a baffled enclosure around a discharge slot 63 formed in the rear face of the exhaust treatment device 12. Hence, the exhaust gases from the driveshaft housing above the water exhaust gas discharge ports 51 can expand in the expansion chambers 56 and then again contract through the discharge port 63 so as to provide a further silencing effect therefor. This is accomplished without any complication of the driveshaft housing.

In this embodiment, the exhaust treatment device 52 also has side walls 64 that extend along opposite sides of the driveshaft housing 18 and a joining front wall 65 which is somewhat lower in height and formed as a separate piece for ease of assembly. Art upper edge 66 of the exhaust treatment device 12 is in sealing engagement with a sealing member 67 which additionally forms a closure for the upper portion of the expansion chamber 56. A further sealing flange 68 is formed around the inner periphery of the device 12 and engages a seal 68 carried by the driveshaft housing 18 so as to provide an effective circumferential seal. A lower seal 69 is interposed between a lower portion of the exhaust treatment device 12 and the lower portion of the driveshaft housing 18.

In order to facilitate insertion of the exhaust treatment member 52 around the upper portion of the driveshaft housing, the member 52 is comprised of a first portion from which the sides 64 and rear portion containing the expansion chamber are formed and a front portion 65 that is affixed in any known manner to the rear portion.

Figure 4:
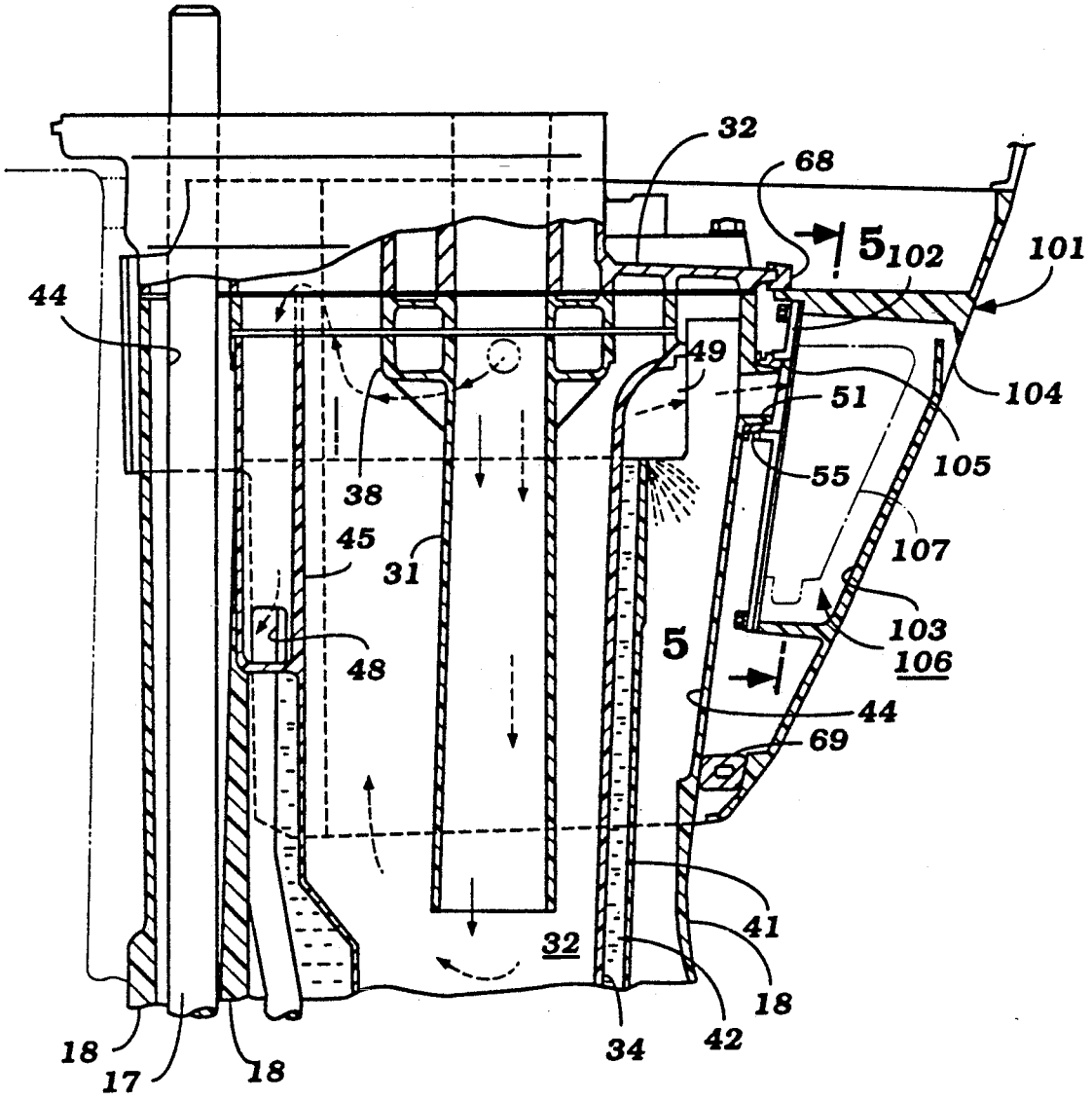
FIG. 4 is a side elevational view, in part similar to FIG. 2 and shows another embodiment of the invention.
Figure 5:
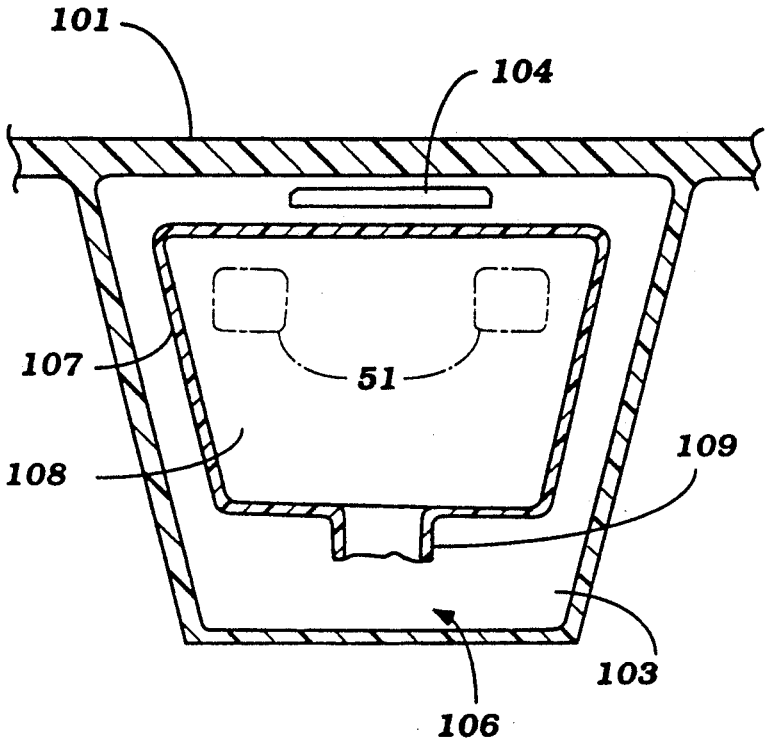
FIG. 5 is a cross-sectional view taken along the line 5—5 of FIG. 4.

FIG. 4 and 5 show another embodiment of the invention which is generally the same as the embodiment of FIGS. 1-3 and for that reason component which are the same have been identified by the same reference numeral and will be described again only in so far as is necessary to understand the construction and operation of this embodiment. In this embodiment, the exhaust treatment device is indicated generally by the reference numeral 101 and it differs from the previous described embodiment only in the way the device 101 cooperates with the low speed exhaust gas outlets 51 of the driveshaft housing 18. For this reason, only that portion of the construction will be described.

In this embodiment, a plate, indicated generally by reference numeral 102 is affixed to the rear portion of the exhaust treatment device 101 in any suitable manner and defines a first expansion chamber 103. This first expansion chamber 103 is formed with an atmospheric exhaust gas outlet 104 that extends at the upper portion of the exhaust treatment device 101 immediately below the powerhead as with the previously described embodiment. An inlet opening 105 is provided in the plate 102 that is sealingly engaged with the seal 55 encircling the low speed exhaust gas outlet openings 51.

In accordance with a preferred structure, a further expansion chamber forming device 106, indicated generally by the reference numeral 106 and comprised of an outer shell 107 defines a further expansion chamber 108 with which the openings 51 communicate. Exhaust gases can thus expand into the expansion chamber 108 and then are discharged into the further expansion chamber 103 through a downwardly facing restricted outlet 109. Thus, the exhaust gases for low speed operation will have two expansions before they are discharged to the atmosphere and this will further improve the silencing effect of the device 101.

In the embodiments of the invention as thus far described, the invention has been described in conjunction with an internal combustion engine 13 which operated on the two stroke crankcase compression principle. Of course, it should be understood that the invention may also be embodied with outboards motors embodying four stroke engines. In connection with such embodiments, the oil pan for the engine 13 may be disposed in the upper portion driveshaft housing 18 above the expansion chamber 32. In such a case, the exhaust pipe 31 can extend either through or to one side of the oil pan and into the lower positioned expansion chamber 32. The exhaust gases are communicated with this expansion chamber to the low speed exhaust gas discharges 51 of the driveshaft housing in any well known manner.

It should be understood from the foregoing description that the embodiments are preferred embodiments. However, it should be readily apparent to those skilled in the art that the invention may be employed in connection with other constructions without departing from the spirit and scope of the invention, as defined by the appended claims.

I claim:

1. An outboard motor comprised of an internal combustion having at least one exhaust port for discharging exhaust gases and an outer housing assembly comprising a driveshaft housing and a protective cowling surrounding said internal combustion engine, said driveshaft housing containing a driveshaft for driving a propulsion device for propelling an associated watercraft, an exhaust system for said engine comprised of an inlet for receiving exhaust gases from said exhaust port, high speed underwater exhaust discharge to which exhaust gases are delivered from said engine through said driveshaft housing and an above the water exhaust gas discharge formed in said outer housing assembly at a point above the water level even when the outboard and associated watercraft are stationary communicating with said exhaust system for discharging exhaust gases directly to the atmosphere, and an exhaust treatment device detachably affixed to said outer housing on the exterior thereof and having an inlet opening communicating with said above the water exhaust gas discharge and an outlet opening communicating directly with the atmosphere externally of said outer housing.

2. An outboard motor as set forth in claim 1 wherein the exhaust treatment device includes an expansion chamber disposed between its inlet opening and its outlet opening.

3. An outboard motor as set forth in claim 2 wherein there are provided a plurality of expansion chambers in the exhaust treatment device.

4. An outboard motor as set forth in claim 3 wherein the expansion chambers are formed to the rear of the driveshaft housing.

5. An outboard motor as set forth in claim 4 wherein the exhaust treatment at least partially encircles the outer periphery of a portion of the outer housing.

6. An outboard motor as set forth in claim 5 wherein the exhaust treatment device is positioned around the upper portion of the driveshaft housing and wherein the above the water exhaust gas discharge is formed in the driveshaft housing.

7. An outboard motor as set forth in claim 6 wherein the outer periphery of the exhaust treatment device is substantially coextensive with the lower portion of the protective cowling.

8. An outboard motor as set forth in claim 2 wherein the exhaust gases flow through the expansion from the above the water exhaust gas discharge to the atmosphere.

9. An outboard motor as set forth in claim 8 wherein there are provided a plurality of expansion chambers in the exhaust treatment device.

10. An outboard motor as set forth in claim 1 wherein the expansion chambers are formed to the rear of the driveshaft housing.

11. An outboard motor as set forth in claim 10 wherein the exhaust treatment device at least partially encircles the outer periphery of the outer housing.

12. An outboard motor as set forth in claim 11 wherein the exhaust treatment device is positioned around the upper portion of the driveshaft housing and wherein the above the water exhaust gas discharge is formed in the driveshaft housing.

13. An outboard motor as set forth in claim 12 wherein the outer periphery of the exhaust treatment device is substantially coextensive with the lower portion of the protective cowling.

14. An outboard motor as set forth in claim 13 wherein the exhaust gases flow through the expansion from the above the water exhaust gas discharge to the atmosphere.

15. An outboard motor as set forth in claim 14 wherein there are provided a plurality of expansion chambers in the exhaust treatment device.

* * * * *

UNITED STATES PATENT AND TRADEMARK OFFICE

CERTIFICATE OF CORRECTION

PATENT NO. : 5,326,295

DATED : July 5, 1994

INVENTOR(S) : Manabu Nakayama

It is certified that error appears in the above-indentified patent and that said Letters Patent is hereby corrected as shown below:

Column 6, line 44, after "driveshaft", insert -- driven by said engi
and a transmission driven by said driveshaft --.

Column 7, line 6, after "treatment", insert -- device --.

Signed and Sealed this

Seventeenth Day of January, 1995

Bruce Lehman

*Attest:*

BRUCE LEHMAN

*Attesting Officer*

*Commissioner of Patents and Trademarks*